United States Patent [19]

Williams

[11] Patent Number: 4,571,867

[45] Date of Patent: Feb. 25, 1986

[54] INFORMATION ORGANIZING DEVICE

[75] Inventor: Marvin E. Williams, Worthington, Ohio

[73] Assignee: The Huntington National Bank, Columbus, Ohio

[21] Appl. No.: 559,099

[22] Filed: Dec. 7, 1983

[51] Int. Cl.[4] ..... B42F 5/00

[52] U.S. Cl. ..... 40/405; 40/124.4; 40/373; 40/388

[58] Field of Search ..... 40/373, 374, 388, 405, 40/124.4, 124, 124.2, 158 R, 122, 159

[56] References Cited

U.S. PATENT DOCUMENTS 2,226,976 12/1940 Leaming ..... 40/405

4,232,463 11/1980 Spees ..... 40/373

FOREIGN PATENT DOCUMENTS 941624 11/1963 United Kingdom ..... 40/124

*Primary Examiner*—Gene Mancene

*Assistant Examiner*—Cary E. Stone

*Attorney, Agent, or Firm*—Frank H. Foster

[57] ABSTRACT

The present invention is an improved information organizing device fashioned from a sheet material in which columns of parallel slits are made. These slits form columns of opposing, downwardly converging legs of material. Between these legs of material is placed a pinch crease that imparts a twist in the legs raising certain edges of the legs and thus facilitating the insertion of information vehicles such as memo cards.

3 Claims, 5 Drawing Figures

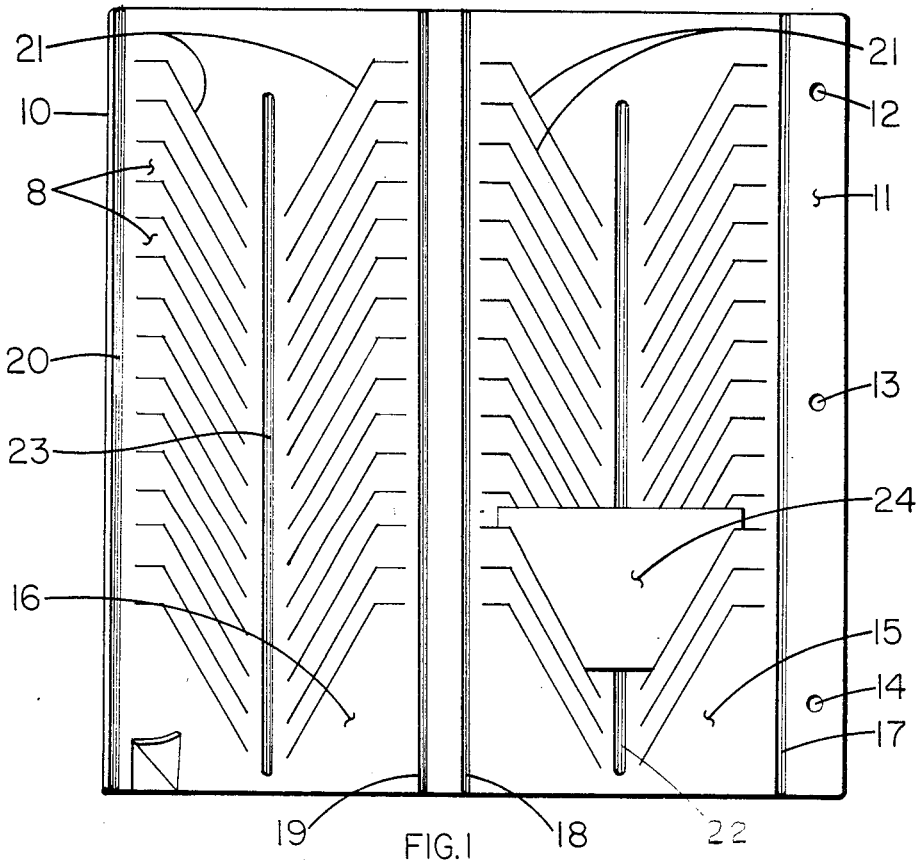
FIG.1
FIG.2
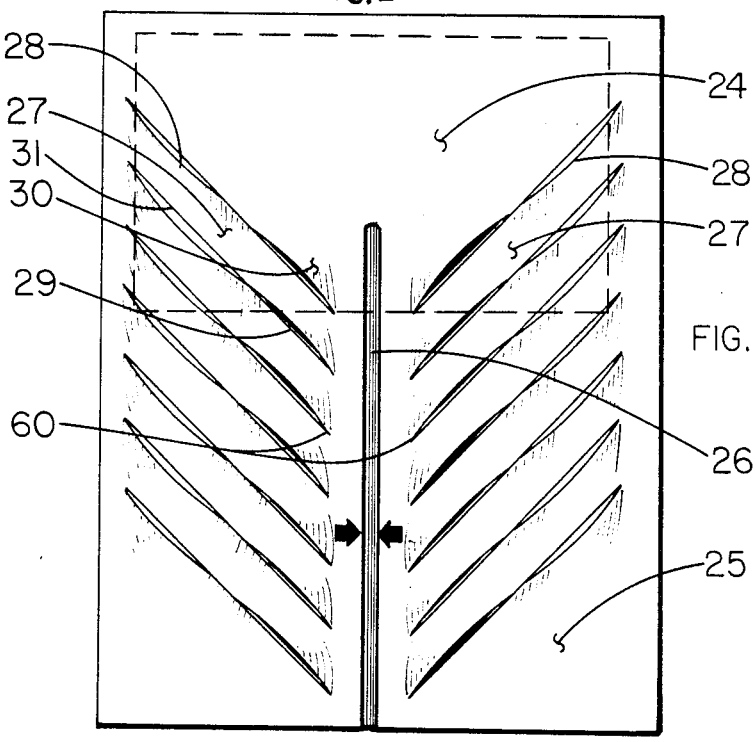
FIG. 2

INFORMATION ORGANIZING DEVICE

BACKGROUND OF THE INVENTION

The present invention relates to an improved passive information organizing device and more particularly to those which include a number of memo cards, credit cards, pictures or other information vehicles and a carrier or holder having vehicle-receiving openings formed by slits in sheet material.

BACKGROUND ART

The prior art discloses many information organizing devices. Some of these devices are constructed of layered sheets of materials with an outer sheet that has slits formed therein to form pockets for receiving information vehicles such as memo cards, credit cards, pictures or other generally flat articles. Information organizing devices made of sheet material frequently cause the user to encounter a problem inserting the information vehicle into the pocket or slits of the outer sheet. The bottom corners often do not slip into the pocket but instead jam against the edge of the material at the slit. Encountering this difficulty frequently causes the user to damage the information vehicle. Thin paper items, such as memo cards or pictures, when being inserted into the pockets or slits of an information organizing device, are easily damaged at their edges or bent. This usually occurs when the user applies the corner of the information vehicle as a lever to pry the slits apart. Additionally, when rows of parallel slits are in opposing columns the user finds himself placing an information vehicle in a slit or pocket in one column and then being unable to easily find the adjacent corresponding slit in the opposing column.

An example of the difficulty encountered with information organizing devices made out of sheet material is evidenced by U.S. Pat. No. 2,226,976 to Leaming. In this invention two rows of downwardly angling slits are made in an outer sheet to form pockets for information vehicles. These slits are made during manufacture and separate the sheet material into downwardly angled legs of material between the slits. In the Leaming structure there is little or no gap in the material caused by the slit between these legs.

In the Leaming patent, at the upper end of the slits are slots cut out of the material. These slots in the Leaming patent are intended to facilitate the insertion of information vehicles. These slots add additional problems during the manufacture of the information organizing device. They require the additional step of punching out the material in the sheet so the gaps will exist between the parallel legs formed by the slots. Once the information organizing device is fully manufactured the outer sheet with the slits placed in it lies flat upon an inner, rigid sheet of material. When the outer sheet is made of a thin, flexible material, such as vinyl or paper, the legs of material between the slits lie flat upon the inner sheet and present the same difficulties when one attempts to insert the information vehicle into the pockets formed by the slits. The slots punched out of the material do not significantly aid in the insertion of the information vehicles because the edges of the legs of material formed by the slits are lying flat against the inner sheet of material. One must still use the information vehicle to pry up the edge of the downwardly extending legs in order to insert an information vehicle into the slots forming pockets.

When the sheets of material used to construct an information vehicle are all vinyl or another synthetic resin static electricity builds up in the material and causes the sheets to adhere to one another. This further complicates the insertion of information vehicles when the legs of material between the slits are manufactured to lie flat upon an inner sheet of vinyl or synthetic resin material.

An attempt to overcome the difficulties of inserting information vehicles into pockets formed by slits in sheet material is found in U.S. Pat. No. 4,008,742 to Lemler. In the system disclosed in this patent, pockets are formed when slots are cut from an outer sheet material. The pockets are made to separate for insertion of information vehicles by placing strips of material behind the pockets extending to the outer edge of the pockets. These strips are between the outer sheet forming the pocket and the stiff inner sheet of the information organizing device. The insertion of these strips causes additional steps and expense in manufacturing and also creates additional bulk for the information organizing device. The presence of these strips within the pockets can give the information vehicle an additional piece of material upon which to snag or become bent.

BRIEF DISCLOSURE OF THE INVENTION

The present invention is an information organizing device constructed of a flexible sheet material into which at least one column of a plurality of nearly parallel slits are made to form legs in the material. A pinch crease is fashioned into the material near either or both of the terminal ends of the slits and at an angle to the slits so as to impart a twist into the legs raising certain portions of the edges of the legs to facilitate the insertion of flat information vehicles such as memo cards.

This invention is a passive information organizing device constructed of a sheet material which receives at least one information vehicle. The information organizing device holds an information vehicle when it is inserted into a vehicle receiving opening. Each of the information vehicle receiving openings in the preferred embodiment are formed by opposing slits in the sheet material that converge in a downward direction to form a pocket for the information vehicle. Placed between the terminal points of each downwardly converging slit is a pinch crease. The pinch crease causes the legs of sheet material formed between parallel vehicle receiving openings to twist and the edges of these legs will separate. The placement of the pinch crease between the opposing, downwardly converging legs of material causes those legs to have a three dimensional form.

The current invention improves upon information organizing devices made of sheet materials in which pockets are formed by slits. The improvement causes the legs of material present between parallel slits to twist. This twisting raises and lowers opposed edges of material forming the legs between the slits. This allows one to easily insert into the vehicle receiving openings flat articles. The pinch crease, which causes the legs of sheet material to twist, can easily be made in manufacturing and is more economical than adding strips of material to cause the vehicle receiving openings to lift upward at their edges. The pinch crease pulls the material together at the point of converging of the slits of the vehicle receiving openings. This twist imparted in the legs of material between the parallel slits is sufficient to facilitate the insertion of information vehicles but is not such that the outer sheet of material will not lie flat when compressed against other sheets similarly manufactured.

An object of this invention is to provide an information organizing device having slits formed in a sheet material to create vehicle receiving openings where edges are partially raised to better receive flat information vehicles.

Another object of this invention is to provide a means for imparting a twist into legs formed in a sheet material between parallel slits.

BRIEF DESCRIPTION OF THE DRAWINGS

FIG. 1 illustrates a plan view of an embodiment of the invention suitable for use in the format of a loose-leaf binder notebook.

FIG. 2 illustrates a plan view of the invention using straight lines to form parallel slits in a sheet material and a phantom view of an information vehicle about to be inserted into the parallel slits.

Figure 3:
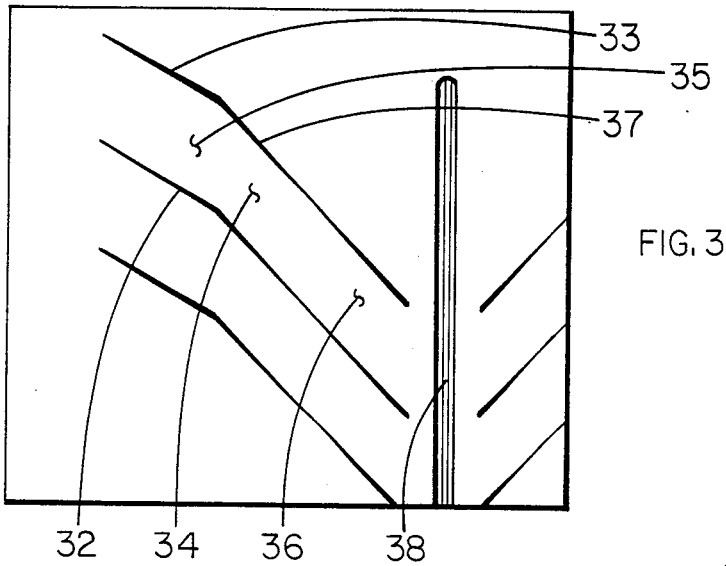
FIG. 3 illustrates a plan view of an alternative embodiment of the invention where the slits formed parallel to one another are formed at obtruse angles in the sheet material.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

Referring to FIG. 1 information organizing devices 10 can be constructed from any suitable material. In the preferred embodiment a stiff inner sheet of cardboard 10A is covered and sealed in a vinyl sheet material. The vinyl sheet material is illustrated as peeled back to reveal the interior cardboard 10A. This combination gives the preferred embodiment its panel shape. Overlaid above this combination is a second layer of vinyl sheet material. In this second outer vinyl sheet material are vehicle receiving openings formed by various shapes and arrangements of slits. Information vehicles are inserted into the vehicle receiving openings.

FIG. 1 illustrates a preferred embodiment of the current invention for use in information organizing devices 10 constructed in a notebook fashion. Embodiments of this invention can be fashioned in covers of notebooks or pages in looseleaf binders. In this example the information organizing device 10 is constructed to be a page suitable for insertion into a looseleaf binder notebook. Along the one edge of this page or information organizing device 10 is a ring binder insert tab 11. On this tab are ring binder holes 12, 13 and 14. In this particular embodiment there are two vehicle receiving opening columns 15 and 16 parallel to one another on each face of the information organizing device 10. Optional lateral brace creases 17, 18, 19 and 20 may be present to lend support to the edges of each column 15 and 16 of vehicle receiving openings. The lateral brace creases 17, 18, 19 and 20 may be molded into the sheet material forming the information organizing device 10 or even sewn into the material. In each vehicle receiving opening column 15 and 16, parallel slits 21 are cut into the outer sheet material to accommodate the contemplated information vehicle to be served. In this embodiment the information vehicle to be accommodated is a memo card 24.

On each vehicle receiving opening column 15 and 16, between the parallel slits 21 present on each column, is a pinch crease 22 and 23. This crease may be made in the outer sheet material of the information organizing device 10 in any appropriate manner. Where this outer sheet is made of a vinyl sheet material or another synthetic resin the pinch creases 22 and 23 may be molded or heat infused. The pinch creases 22 and 23 serve to pull the sheet material forming the outer sheet of the information organizing device together beteen the opposing, downwardly converging parallel slits 21. The placement of pinch creases 22 and 23 in this manner imparts a twist in the legs 8 of material present between the parallel slits 21. This twist raises certain edges of the material to facilitate easy insertion of a memo card 24.

Illustrated in FIG. 2 is an embodiment of an information organizing device 25 formed from a sheet material. This embodiment has parallel slits forming legs 27 of twistable sheet material. A pinch crease 26 imparts a slight twist into the legs 27. In this embodiment the pinch crease 26 is near the terminal ends 60 of the slits present in columns and equal distance from each terminal end 60. When the legs 27 are linear as in this embodiment, a pinch crease 26, perpendicular to the slits, will not twist the legs 27. Therefore, with lineal legs the pinch crease 26 must be at some angle other than a right angle to the slits forming the legs 27. The degree of angle selected will affect the amount of twist imparted into the legs 27. Slits at steep angles from a pinch crease will impart the most twist to a leg of material.

A twist raises a portion of the upper and lower edge of each leg 27. Upper raised edge portion 28 and lower raised edge portion 29 of leg 27 are illustrated. Likewise, upper depressed edge portion 30 and lower depressed edge portion 31 are also illustrated. These edges are raised or depressed by the twist in the leg 27 caused by the pinch crease 26. Upper raised edge portion 28 facilitates the insertion of an information vehicle. The twist imparted into leg 27 is not such that the legs 27 will not lie flat when compressed. Because of this, when numerous sheets of information organizing devices are pressed together as in the noebook embodiment of FIG. 1, the twist in the leg 27 will not become creased or bent, but will be pressed flat.

Regardless of the shape of the parallel slits used to form legs 27 of material, a twist in the legs 27 imparted by a pinch crease 26 will cause the uppermost portion of the upper edge of leg 27 of material to raise. This upper raised edge portion 28 will occur on the top portion of the top edge of each leg 27 of material. The length of slits to be fashioned into an information organizing device 25 may be calculated such that the upper raised edge portions 28 of two opposing, downwardly converging legs of material will correspond approximately to the length of an edge of the information vehicle to be inserted. In this manner the two lower corners of an information vehicle 24, illustrated in phantom technique, can easily be located prior to insertion at the corresponding upper raised edge portion 28.

The placement of a pinch crease 26 between the opposing downwardly converging legs 27 of material imparts the twist into the legs 27. The pinch crease 26 pulls the material forming opposing legs 27 together. Any method to pull these segments of material together will serve as a pinch crease. As stated above the preferred embodiment has the pinch crease 26 formed in an outer sheet of material used to construct the information organizing device 25 by heating a line between the opposing, downwardly converging legs 27 of material. Once the heating device is withdrawn the synthetic resin material, in this example, vinyl, cools and contracts to form the pinch crease 26. With other materials different methods to pull these sections of sheet material together will be required. For example, if the information organizing device 25 is constructed of leather or cloth sheet material a thread-like material (not shown) may be placed between the opposing, downwardly converging legs of material in a "shoe lace" fashion such that the thread-like material when pulled tightly forms a pinch crease. To facilitate the placement of a pinch crease in these materials a slot may be cut out of the sheet material and its sides then pinched or pulled together. The sides of the slot may be held in this position by thread-like material or even glued to the stiff inner panel sheet of material described above.

Pinch creases do not always have to be placed between two opposing downwardly converging legs of material. Pinch creases on the outward side of these legs will also serve to impart a twist into the legs of material. Regardless of the method of construction or exact location of a pinch crease in the outer sheet material of an information organizing device the pinch crease will impart a twist in the legs of material.

FIG. 3 illustrates an alternative embodiment of a twistable leg 34 formed by two obtrusively angled slits 32 and 33. The leg 34 formed by these parallel slits 32 and 33 has an upper portion 35 and a lower portion 36. The vertex of the angle formed by the upper slit 33 at the juncture of upper portion 35 with lower portion 36 has a raised edge 37. The raised edge 37 is again caused by the twist put into the leg 34 when the pinch crease 38 is made in the sheet material forming this embodiment of an information organizing device. This raised edge 37, present at the vertex of the angle formed by the upper portion 35 and the lower portion 36 of the leg 34, facilitates the insertion of an information vehicle. The angle of the slit 33 forming the raised edge 37 attracts the focus of the eye of one using the information organizing device. The user of the information organizing device can easily find the location of leg 34 that is raised by the twist imparted from the pinch crease 38.

Figure 4:
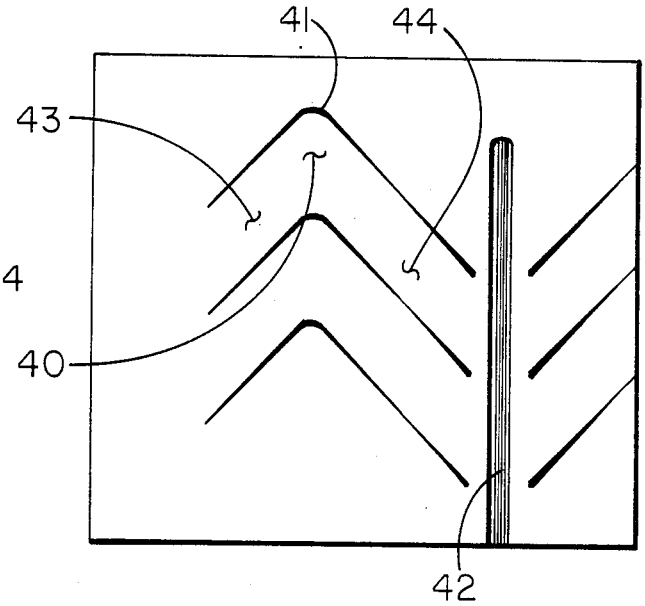
FIG. 4 illustrates a plan view of an alternative embodiment of the invention where parallel slits are formed in acute angles.

FIG. 4 illustrates an alternative embodiment where the leg 40 of the sheet material forms an acute angle. The leg 40 is formed by two distinct sections, the upper portion 43 and the lower portion 44. When the pinch crease 42 is put into the outer sheet material forming the information organizing device the edge 41 at the vertex of the angle of the upper slit in the leg 40 rises. The rise of this edge 41 is more pronounced than in the embodiment shown in FIG. 3 because of the acute angle of the material. Regardless of the degree of angle used to form opposing, downwardly converging legs of material, the twist imparted by a pinch crease will elevate the uppermost portion of the upper edge of the leg of material.

Figure 5:
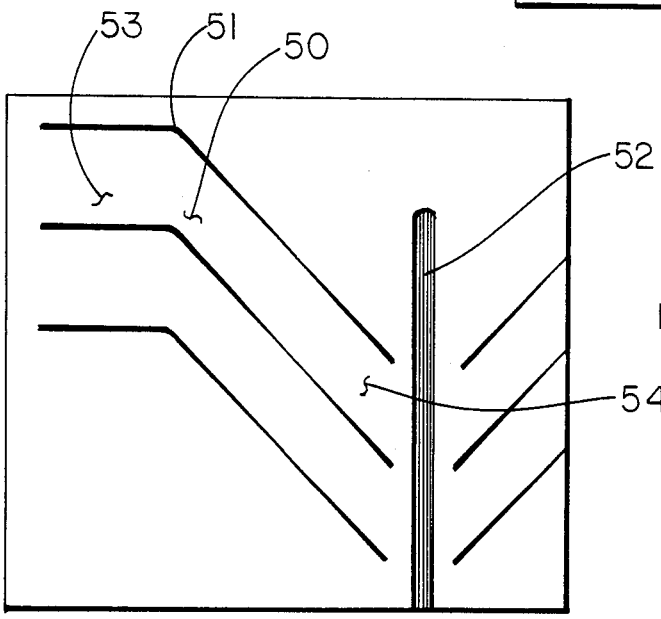
FIG. 5 illustrates a plan view of the preferred embodiment of the invention where slits are formed parallel to one another and have obtruse angles but form a wide upper tab section between them.

FIG. 5 shows the preferred embodiment of the leg 50 formed by parallel slits in sheet material to construct an information organizing device. In this embodiment the pinch crease 52 is put in the usual place between the opposing, downwardly converging legs 50. The upper portion 53 of the leg 50 is wider than the strip of material which forms the lower portion 54 of the leg 50. In this manner the upper edge 51 of the leg 50 will rise to accommodate the insertion of the information vehicles but the entire lower edge of both the upper portion 53 and the lower portion 54 of the leg 50 will be flatter than the entire upper edge of the leg 50. This is because the wider upper portion 53 of the leg 50 resists the twist imparted by the pinch crease 52. The majority of the twist, therefore, affects the edges of the lower portion 54 of leg 50. The lower portion 54 will itself appear much like the embodiment illustrated in FIG. 2. The raised upper edge 51 of the leg 50 equates to the upper raised edge 28 of FIG. 2.

Another benefit of the preferred embodiment is that the wider upper portion 53, when there is a plurality of legs 50 forming a column of vehicle receiving openings, gives the user a larger, more demarcated position upon which to place an information vehicle before insertion. The user of an information organizing device constructed according to the preferred embodiment can easily locate the corresponding upper portions 53 of opposing legs 50 of material. He then places the corners of an information vehicle on any corresponding pair of these upper portions 53. The upper edge 51 of the leg in the column immediately below selected upper portions 53 will be raised to accommodate the information vehicle as it is inserted.

While certain preferred embodiments of the present invention have been disclosed in detail, it is to be understood that various modifications in its structure may be adopted without departing from the spirit of the invention or scope of the following claims.

I claim:

1. An information organizing device comprising:

(a) at least one sheet of a flexible material restrained at its edges from inward movement;

(b) at least two, side by side, spaced columns of downwardly converging slits, each column having a plurality of nearly parallel slits made in said sheet of said flexible material to form legs in said material between parallel slits; and (c) a pinch crease fashioned into said sheet of said flexible material along a central axis between the columns of slits and spaced from the near terminal ends of the parallel slits, the pinch crease gathering the sheet material toward the central axis so as to impart a twist into the legs.

2. An information organizing device as recited in claim 1 further comprising:

(d) a rigid inner sheet over and above which at least one sheet of said flexible material, restrained at its edges from inward movement by said rigid inner sheet, is placed to construct a panel.

3. An information organizing device as recited in claim 2 wherein at least one of said panels is constructed in the fashion of a notebook page.

* * * * *